US007114675B1

(12) United States Patent
Kohler

(10) Patent No.: US 7,114,675 B1
(45) Date of Patent: Oct. 3, 2006

(54) DUAL-DRUM WINDING MACHINE

(76) Inventor: Herbert B. Kohler, 10995 Wright Rd., NW., Uniontown, OH (US) 44685

( * ) Notice: Subject to any disclaimer, the term of this patent is extended or adjusted under 35 U.S.C. 154(b) by 181 days.

(21) Appl. No.: 10/443,244

(22) Filed: May 22, 2003

(51) Int. Cl.
*B65H 18/14* (2006.01)

(52) U.S. Cl. ..... 242/542

(58) Field of Classification Search ..... 242/541.2, 242/541.4, 541.7, 542, 542.2, 542.3, 547
See application file for complete search history.

(56) References Cited

U.S. PATENT DOCUMENTS

| | | | | |
|---|---|---|---|---|
| 2,989,262 | A | 6/1961 | Hornbostel | |
| 3,045,940 | A * | 7/1962 | Aulen | 242/542 |
| 3,817,467 | A | 6/1974 | Dambroth | |
| 3,889,892 | A | 6/1975 | Melead | |
| 3,972,486 | A * | 8/1976 | Straujups | 242/542 |
| 4,565,337 | A * | 1/1986 | Mondini et al. | 242/542 |
| 4,598,877 | A * | 7/1986 | Oinonen | 242/542 |
| 5,137,225 | A * | 8/1992 | Biagiotti | 242/542 |
| 5,222,679 | A * | 6/1993 | Dropczynski et al. | 242/542 |
| 5,335,871 | A * | 8/1994 | Fissmann et al. | 242/542 |
| 5,507,450 | A | 4/1996 | Hoar | |
| 5,538,199 | A * | 7/1996 | Biagiotti | 242/541.2 |
| 5,562,261 | A * | 10/1996 | Beisswanger et al. | 242/542 |
| 5,593,106 | A | 1/1997 | Cavanagh | |
| 5,839,689 | A * | 11/1998 | Kruger et al. | 242/542 |
| 5,855,337 | A * | 1/1999 | Schonmeier et al. | 242/542 |
| 5,899,405 | A * | 5/1999 | Kruger et al. | 242/542 |
| 6,752,345 | B1 * | 6/2004 | Betti et al. | 242/542 |

* cited by examiner

*Primary Examiner*—William A. Rivera
(74) *Attorney, Agent, or Firm*—Pearne & Gordon LLP

(57) ABSTRACT

A dual drum winding machine is provided for winding a web of material, e.g., textile material, around a central core. The winding machine is operable on a continuous basis and has a leading winding drum and a succeeding winding drum. The succeeding winding drum is positioned lower than the leading winding drum such that the succeeding winding drum supports a greater proportion of the weight of a forming web roll when the roll is in a winding position supported by both the leading and succeeding winding drums. A method of forming a web roll using the winding machine is also provided.

31 Claims, 5 Drawing Sheets

DUAL-DRUM WINDING MACHINE

BACKGROUND OF THE INVENTION

1. Field of the Invention

The invention relates to a winding machine for winding a web of paper or other raw material or textile stocks, e.g. polymeric films, into large rolls. More particularly, it relates to a dual-drum winding machine capable of producing uniformly tightly wound rolls of such web material across the entire radius of the roll.

2. Description of the Related Art

In conventional dual-drum winding machines, a web of material, e.g. paper, polymeric sheet or film, textile material, etc., is continuously wound on a central core from a source of the web material that is fed continuously from outside the winding machine. As more of the web material becomes wound around the central core, the diameter of the resulting roll increases commensurately, with the increasing diameter roll being supported in a position substantially centered between two adjacent and level support rolls or drums.

U.S. Pat. No. 5,593,106 discloses a typical conventional dual-drum winder characteristic of the prior art, and is incorporated herein by reference. FIG. 1 of the '106 patent shows the web roll of increasing diameter supported in a rolling position B between two adjacent and level winding drums 36 and 38. As the drums 36 and 38 are rotated clockwise, the web roll is thereby caused to rotate counter-clockwise and thus to wind additional web material thereon from the web material source shown at W in FIG. 1 of '106. Once the web roll has achieved its final diameter D, the piston-driven cutter 48 extends upward to cut the web source from the now complete web roll, and the finished roll is urged out of the machine via an ejection mechanism comprising a sweep arm 42 and associated piston 44 as shown in the figure.

From FIG. 1 of '106 and the foregoing description, it will be evident to those skilled in the art that existing winding machines such as that disclosed in '106 rely on the web source, which supplies the web material to the winding machine, to also supply the necessary web tension to provide a tightly wound finished web roll. This arrangement results in poorly tensioned web rolls causing the finished rolls to have nonuniform radial or layer density (density of web material on the finished roll measured in layers of web material per radial inch).

In addition, as the source web material is severed from the finished web roll, a long and loose untensioned flap portion of source web material results. This loose flap portion is pressed against a newly supplied central core to begin forming the next successive web roll. The loose flap portion is not tensioned by the web source because the web is severed downstream of the leading drum roller (e.g. roller 32 in FIG. 1 of '106). Hence, the loose flap portion of the web material typically includes myriad folds, creases, lines, wrinkles and other random undesirable gatherings of web material characteristic of untensioned webs. As this loose flap portion is laid against the spinning newly supplied central core, additional layers of web material are wound thereover as the web roll grows. As these additional layers are wound on the creased, untensioned underlying layers, they too become creased and folded, exhibiting undesirable gathering characteristic of web material that has not been properly tensioned. The fact that the web is conventionally severed some distance (e.g. 12 inches, or up to 2 or 4 feet or more) from the newly supplied central core contributes significantly to this problem because the resulting loose flap is very long; sometimes many times the circumference of the central core. The overall result is that a significant portion of the finished web roll within a certain radial distance from the central core is unusable in subsequent processing operations for which tightly and uniformly tensioned material webs are required. In fact, the folds and creases in the rolled web material can lead or contribute to exactly the edge profile defects of finished web rolls with which the '106 patent was principally concerned.

Accordingly, there is a need in the art for a dual-drum winding machine that overcomes the aforementioned deficiencies characteristic of the prior art. Preferably, such an improved dual-drum winding machine will not rely solely on the web source to supply web tension to the forming web roll. Also preferably, such an improved machine will significantly minimize or substantially eliminate the loose flap portion supplied to fresh central cores which has been characteristic of and problematic in the prior art.

SUMMARY OF THE INVENTION

A winding machine for winding a web of material around a central core is provided. The machine has a leading winding drum having a surface and a succeeding winding drum having a surface, the leading and succeeding winding drums being arranged such that a first horizontal plane tangent to a topmost position of the surface of the leading winding drum is located above a second horizontal plane tangent to a topmost position of the surface of the succeeding winding drum.

A method for winding web material around a central core is also provided including the following steps: a) providing a winding machine that has a leading winding drum having a surface and a succeeding winding drum having a surface, the leading and succeeding winding drums being arranged such that a first horizontal plane tangent to a topmost position of the surface of the leading winding drum is located above a second horizontal plane tangent to a topmost position of the surface of the succeeding winding drum; b) providing a substantially cylindrical central core for winding the web material therearound to form a web roll; c) supporting the web roll in a winding position against both the leading winding drum and the succeeding winding drum; and d) winding the web material onto the web roll in the winding position.

A further method for winding web material around a central core is provided having the following steps: a) providing a winding machine having a leading winding drum and a succeeding winding drum; b) providing a substantially cylindrical core for winding the web material therearound to form a web roll; c) supporting the web roll in a winding position against both the leading winding drum and the succeeding winding drum; d) winding the web material onto the web roll in said winding position; and e) supporting or pressing the web roll against the succeeding winding drum with greater force than against the leading winding drum.

A still further method for winding web material around a central core is provided having the following steps: a) providing a winding machine having a leading winding drum and a succeeding winding drum; b) providing a substantially cylindrical core for winding the web material therearound to form a web roll; c) supplying a web of the web material to the winding machine via a web pathway of the machine; d) supporting the web roll in a winding position against both the leading winding drum and the succeeding winding drum; e) winding the web material onto the web roll in the winding position; f) tensioning the web of web material in a position ahead of the leading winding drum relative to the web pathway; and g) tensioning the web of web material in a position adjacent the winding position.

DETAILED DESCRIPTION OF PREFERRED EMBODIMENTS

As used herein, when a range such as 5–25 (or 5 to 25) is given, this means preferably at least 5 and, separately and independently, preferably not more than 25.

Figure 1:
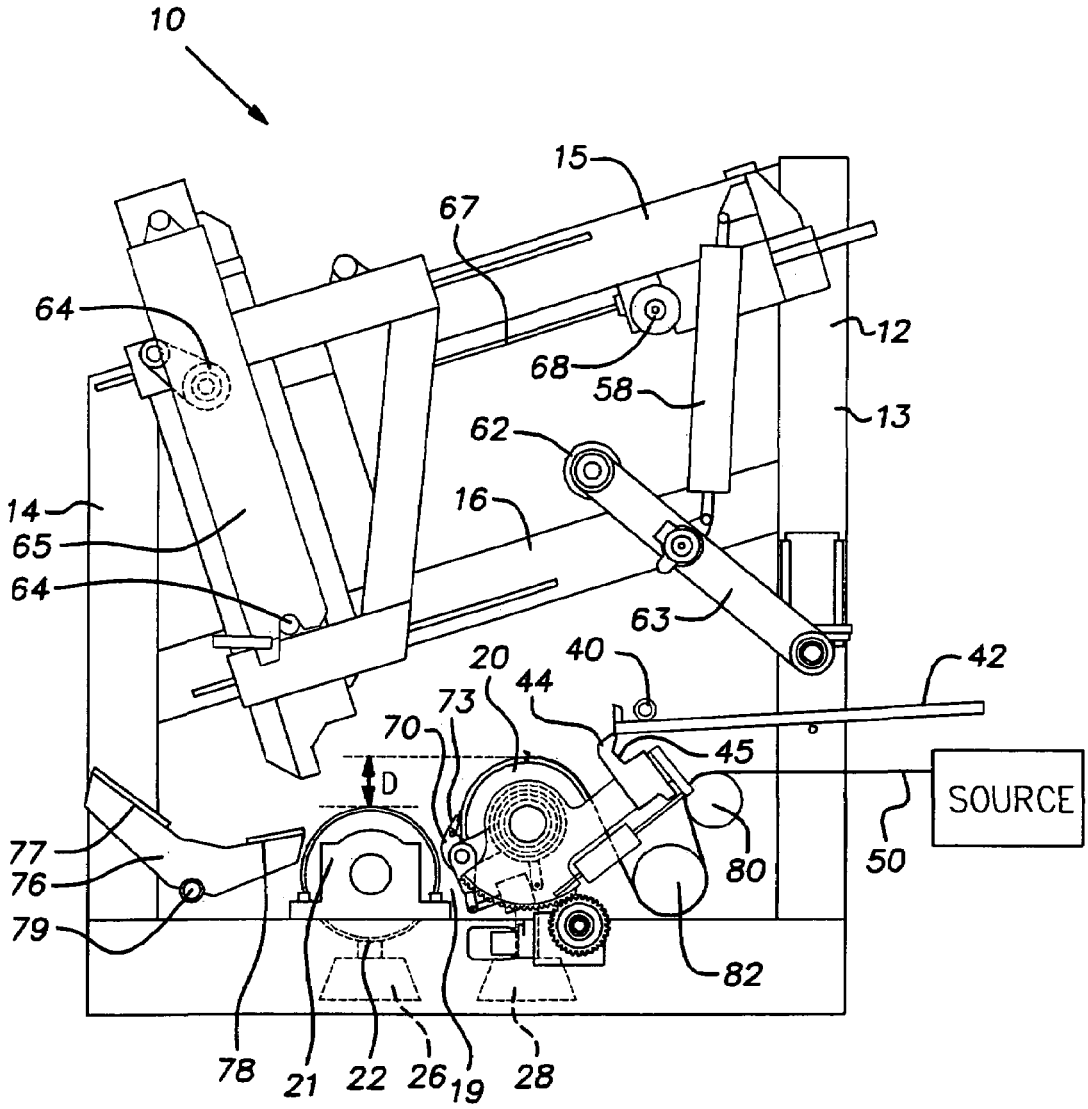
FIG. 1 is a side schematic view of a dual-drum winding machine according to a preferred embodiment of the invention.
Figure 2:
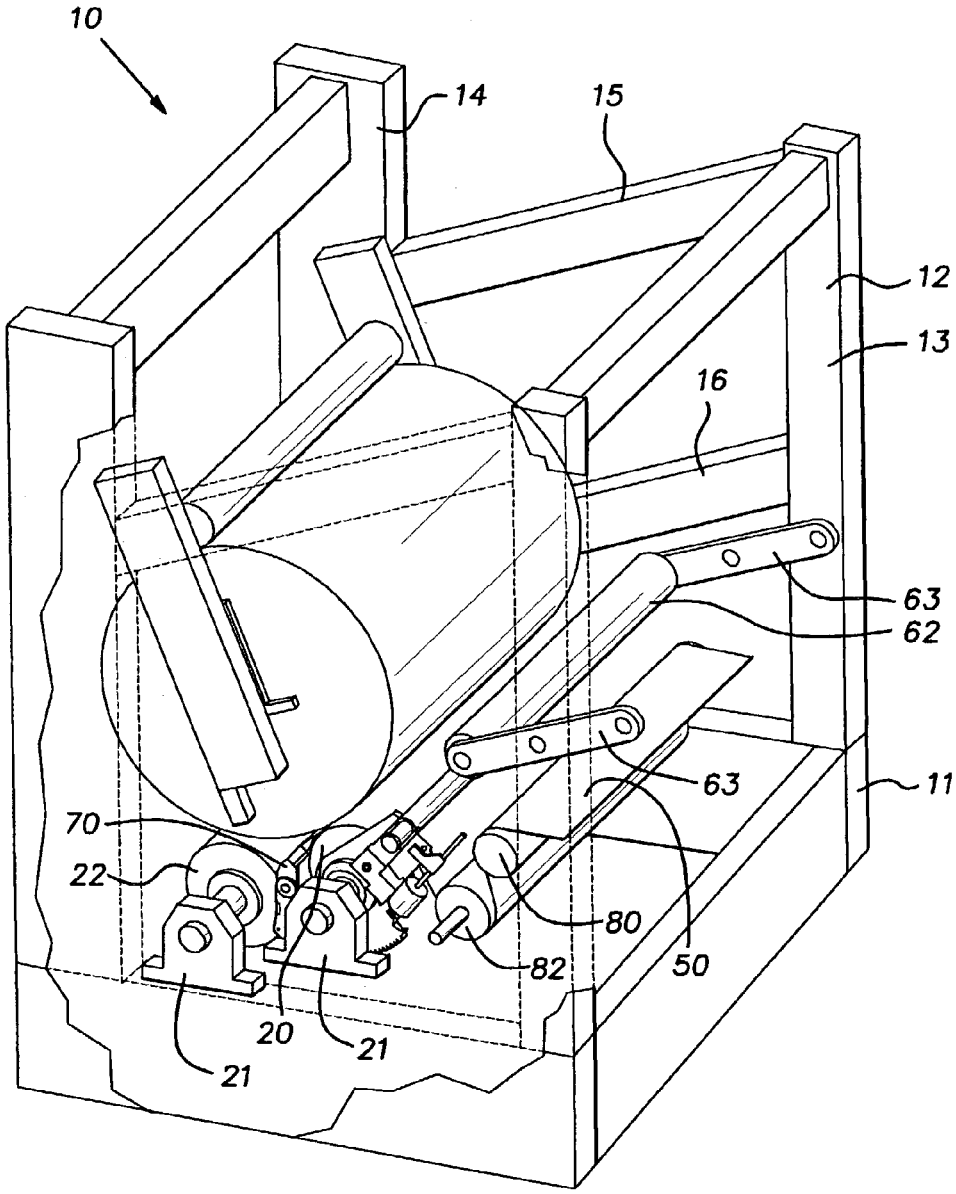
FIG. 2 is a perspective view, partially broken away, of the dual-drum winding machine of FIG. 1.

Referring to FIG. 1, a preferred embodiment of the dual drum winding machine according to the invention is shown generally at 10. In this embodiment, the winding machine 10 has a structural frame 12 having first and second vertical support structures 13 and 14 respectively which are rigidly interconnected by upper and lower rails 15 and 16 respectively. Each of the vertical support structures 13 and 14 can be provided as a series or construct of beams having a generally inverted U-shaped configuration mounted to or supported by base structures 11 as shown, e.g., in FIG. 2. Optionally, side panels (not shown) can be provided and mounted to the vertical support structures 13 and 14 on either side of the machine 10 to shield its moving components from debris or personnel. The upper rails 15 and lower rails 16 are parallel, and are preferably inclined in a direction from the second vertical support structure 14 toward the first vertical support structure 13 as shown in the figure in order to facilitate the proper alignment between a substantially vertical translational path of a second friction roller 64 and a roll 40 in a primary winding position B (see FIG. 6) as will be further described.

Substantially centrally located between the first and second vertical support structures 13 and 14, at or adjacent the base of the winding machine 10, a pair of winding drums 20 and 22 are provided. The winding drums 20 and 22 are generally cylindrical in shape and extend between the base structures 11 of the frame 12. The winding drums 20 and 22 are preferably rotationally supported by drum mounts 21. The winding drums 20 and 22 are spaced apart from one another such that a gap 19 is provided therebetween. The first or leading winding drum 20 is preferably the same diameter as the second or succeeding winding drum 22. The leading winding drum 20 is coupled to a first drive motor 24 and the succeeding winding drum 22 is coupled to a second drive motor 26. Each drive motor 24 and 26 (shown schematically in FIG. 1) is capable of separately rotating and controlling the rotational speed of its respective winding drum 20 and 22. The leading winding drum 20 is elevated relative to the succeeding winding drum 22 such that a horizontal plane tangent to the topmost position of the surface of the leading winding drum 20 is located in a vertical position above a corresponding horizontal plane tangent to the topmost position of the surface of the succeeding winding drum 22. Preferably, the vertical distance D between the topmost position of the surface of the leading winding drum and that of the succeeding winding drum is at least 1 inch, preferably at least 2, 3, 4, 5, 6, 7, 8, 9, 10, 11, 12, 14, 16, 18, 20, 22, 24, 30, 36, 42, or 48, inches. Alternatively, the vertical distance D is selected to accommodate the desired final diameter of the rolls to be wound by the winding machine.

In operation, the winding machine 10 winds web material 50, which is supplied from a source outside of the machine (shown schematically in the drawings as "SOURCE") onto a series of continuously and successively provided tubular cores 40. Additional machine elements of the invented winding machine 10 will now be described in reference to its manner of operation. Because the machine 10 operates continuously to supply successive cores 40 with web material 50, multiple cores can be present within or on the machine 10 at the same time. Therefore, in the figures, in particular FIGS. 3–7, the same core is indicated by the same letter as it progresses through the machine. For example, core 40*a* represents the same core as it proceeds through the machine, while core 40*b* is a new or successive core. Also, for simplicity reference numeral 40*a* will be used to refer to a forming roll (including the respective core and web material wound thereto) as it proceeds through the winding machine.

Figure 3:
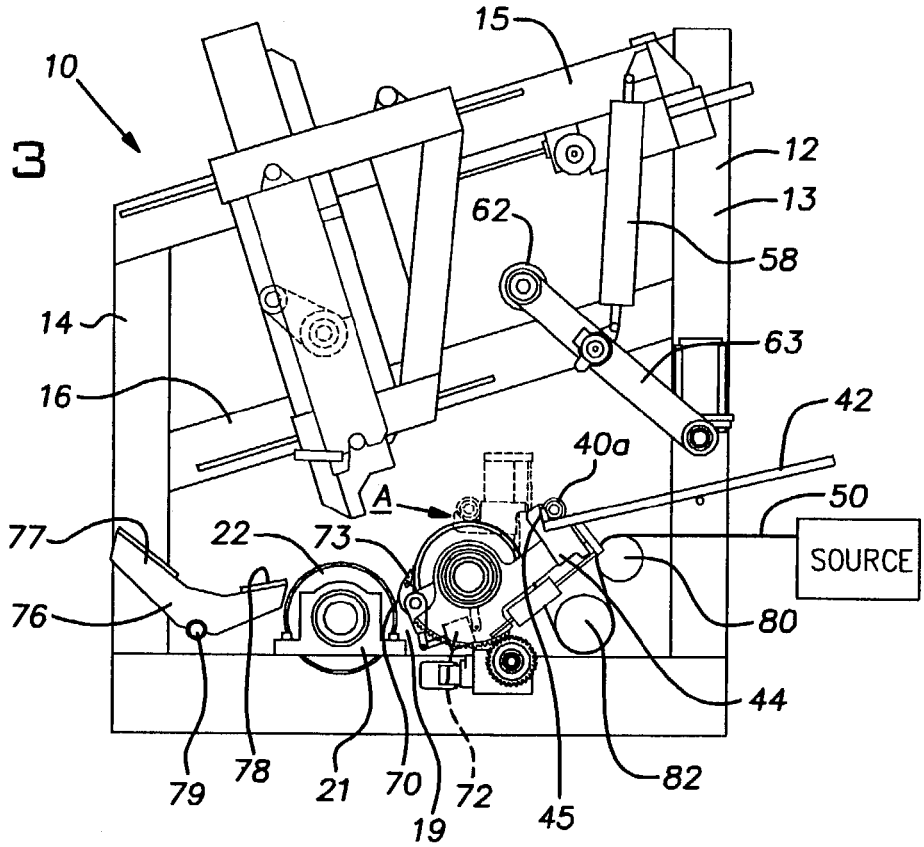
FIG. 3 is a side view as in FIG. 1, shown at an initial stage of a winding operation having a central core for a web roll at a loading position.

Referring to FIG. 3, a fresh core 40*a* is supplied to the winding machine 10. The core 40*a* can be provided, e.g., via delivery ramp 42, with the core 40*a* being initially supplied to the delivery ramp 42 via mechanical or conventional means. The delivery ramp 42 is equipped at its distal end (adjacent the leading winding drum 20) with a core retention means effective to retain the core 40*a* on the delivery ramp 42 until the core 40*a* is engaged by the core carriage 44. The core carriage 44 is equipped with a cradle 45 for receiving the core 40*a*, and retaining the core 40*a* therein. As the carriage 44 engages the core 40*a* from the delivery ramp 42, the core 40*a* is received within the cradle 45 and the delivery ramp 42 is free to accept another or subsequent core. After the core 40*a* is received in the cradle 45, the carriage translates substantially circumferentially about the leading winding drum 20 to deliver the core 40*a* from its loading position (shown in solid lines in FIG. 3) to an initial winding position A located adjacent the topmost position of the surface of the leading winding drum 20 (shown in phantom in FIG. 3).

Figure 4:
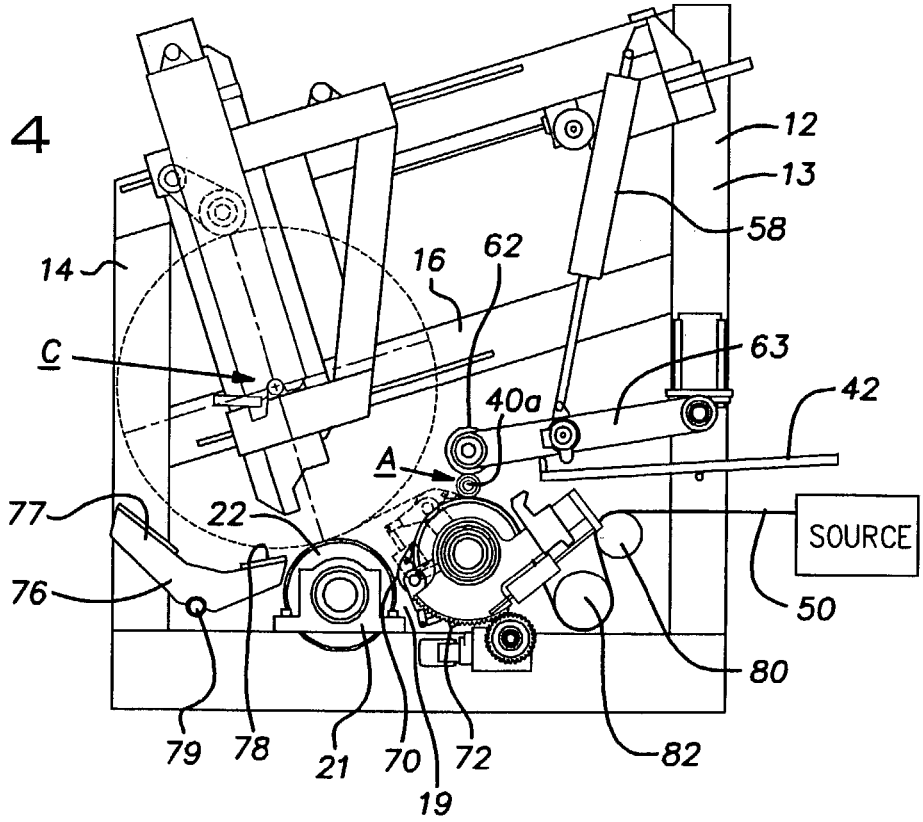
FIG. 4 is a side view as in FIG. 3, except at a further stage of the winding operation with the central core having advanced to an initial winding position.

Referring next to FIG. 4, in the initial winding position A, a first friction roller 62 engages the core 40*a* from above, and presses the core 40*a* securely against the leading winding drum 20. The core carriage 44 returns to its loading position and is ready to receive the next successive core from the ramp 42. In the preferred embodiment depicted in the figure, the first friction roller 62 is mounted at either end to the distal ends of a pair of lever arms 63, which are pivoted from the first vertical support structure 13 at their proximal ends. A hydraulic piston or pair of hydraulic pistons 58 is/are coupled to the lever arms 63 from above, and supply the force to raise and lower the friction roller 62 into and out of engagement with the core 40*a* in the initial winding position A, and also the pressing force with which the friction roller 62 presses the core 40*a* against the first winding drum 20.

Figure 1A:
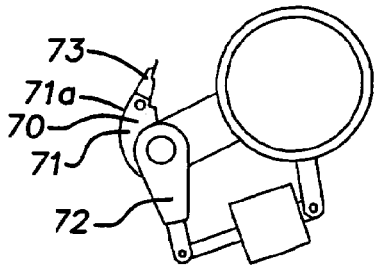
FIG. 1*a* is a close-up view of the web cutting device of FIG. 1.

Located generally within the gap 19 between the leading and succeeding winding drums 20 and 22, a web cutting device 70 is provided. The web cutting device 70 (see FIG. 1*a*) includes a substantially arc shaped first portion 71 having a convex surface mounted to or pivoted from a cutter carriage portion 72. At the end of the first portion 71, opposite the point of attachment to the carriage portion 72, a cutting edge or knife 73 is provided. Preferably, the convex surface of the arc shaped first portion 71 tapers off toward a substantially planar portion 71*a* thereof, so that a planar surface is provided immediately adjacent the point of attachment of the cutting knife 73. The carriage portion 72 is actuated or controlled such that the cutting device 70 translates substantially circumferentially about the leading winding drum 20 from its resting position in the gap 19 between the drums 20, 22 (shown in solid lines in FIG. 4) to a cutting position with the cutting knife 73 positioned adjacent the topmost position of the surface of the leading winding drum 20 (shown in phantom in FIG. 4). As will be further explained below, in operation the knife 73 severs the traveling web 50 from a completed or substantially completed roll located in a finishing winding position C (see FIG. 7). The web 50 is severed by the knife 73 as nearly as possible to the core 40*a* located in the initial winding position A, preferably less than 11, preferably less than 10, preferably less than 9, preferably less than 8, preferably less than 7, preferably less than 6, preferably less than 5, preferably less than 4, preferably less than 3, preferably less than 2, preferably less than 1, inches from the core 40*a* in the initial winding position A. Simultaneously, the outer convex surface of the arc shaped first portion 71 engages or presses upward against the traveling web 50 between the leading winding drum 20 and the completed roll, thereby further tensioning the web 50 between the first portion 71 and the first winding drum 20. Thus, at the point where it is severed by the knife 73, the web 50 is very taught such that the resulting flap of the web 50 is caused to recoil sharply against the core 40*a* as a result of its own elasticity and the rebounding force from severing the highly tensioned web. In addition, by severing the web 50 as near to the core 40*a* as possible, the resulting flap that is initially rolled against the core 40*a* surface to begin winding the fresh web roll is as short as possible; this minimizes negative effects resulting from loosely wrapped or folded or creased web material adjacent the core 40*a* surface as described above.

In the initial winding position A, web material is first wound to the central core 40*a* from the point where the knife 73 severed the web material from a previously wound roll. Winding continues in the initial winding position A at least long enough for the cutting device 70 to retract to its resting position within the gap 19 between the drums 20, 22. During this initial phase of winding, the first friction roller 62 presses down against the core 40*a* and the web material 50 wound thereto, compressing the core and wound web material against the leading winding drum 20 to ensure that there is no or substantially no slippage between the newly forming roll 40*a* and the drum 20. It is important to note that the friction roller 62 does not act keep the web 50 tensioned as it is wound to the core 40*a*; in the initial winding position, web tension is supplied by the first and second tension rollers 80 and 82 as will be further described.

Figure 5:
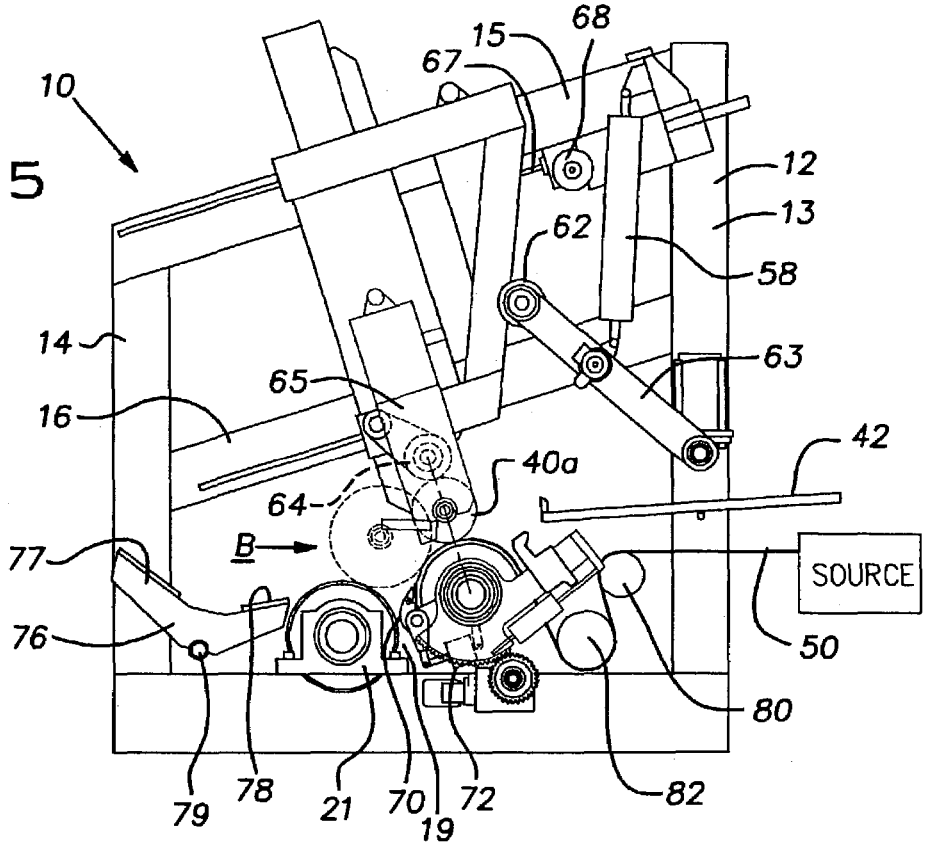
FIG. 5 is a side view as in FIG. 4, at a still further stage of the winding operation with the central core having web material wound thereto still at the initial winding position.

Once the cutting device 70 has fully retracted to its resting position, and the diameter of the forming roll 40*a* has grown to some degree in the initial winding position A, the first friction roller 62 is withdrawn or retracted from engagement with the forming roll 40*a*, and the roll 40*a* is engaged by a second friction roller 64 as seen in FIG. 5. The second friction roller 64 is supported on an overhead translatable carriage 65. The translatable carriage 65 is slidably or translatably coupled to the upper and lower rails 15 and 16 for relative movement in a direction between the first and second vertical support structures 13 and 14, substantially transverse to the central axes of the leading and succeeding winding drums 20 and 22. The movement and relative position of the translatable carriage 65 on the rails 15, 16 is preferably controlled via a servo roller mechanism as follows. The translatable carriage 65 is equipped with a transversely extending servo shaft or linkage 67 mechanically coupled to the carriage 65. The linkage 67 can be rigidly coupled, e.g. via welding or brazing, or pivotally coupled via a pivot joint. The linkage 67 is engaged by a servo wheel 68 such that there is no or substantially no slippage between the surface of the wheel 68 and the linkage 67. The described servo structure is generally known in the art, and is effective to provide very precise position and motion control to the carriage 65 by operation of the wheel 68 to control the degree to which the linkage 67 is extended or retracted relative to the position of the wheel 68. Alternatively, the movement and relative position of the carriage 65 along the rails 15, 16 can be controlled via any suitable or conventional means, e.g., hydraulic or pneumatic pistons, hydraulic or pneumatic transmission, gears and chains, etc. Pistons are generally least preferred because it is difficult to precisely regulate the movement and position of the overhead carriage 65 using a piston.

The second friction roller 64 is translatable along a substantially vertical path (i.e. perpendicular to the rails 15, 16) via conventional translation means. Suitable translation means include conventional gear and chain assemblies, or other conventional means well known in the art. The actual mechanism for translating the second friction roller 64 along its substantially vertical path is not critical to the invention, all that is important is that the mechanism selected is capable of achieving such substantially vertical translation, and that, when the friction roller 64 is engaged against a forming roll, the translating mechanism is capable of supplying sufficient downward force such that the friction roller 64 presses the forming roll securely against the winding drums (leading drum 20 in the initial winding position, both drums 20, 22 in the primary winding position B, described in the next paragraph, and succeeding winding drum 22 in the finishing winding position C, described below). The translating mechanism must be capable of supplying the described downward force to a forming roll while simultaneously being urged upward as a result of increased roll diameter from continuous rolling of web material.

Figure 6:
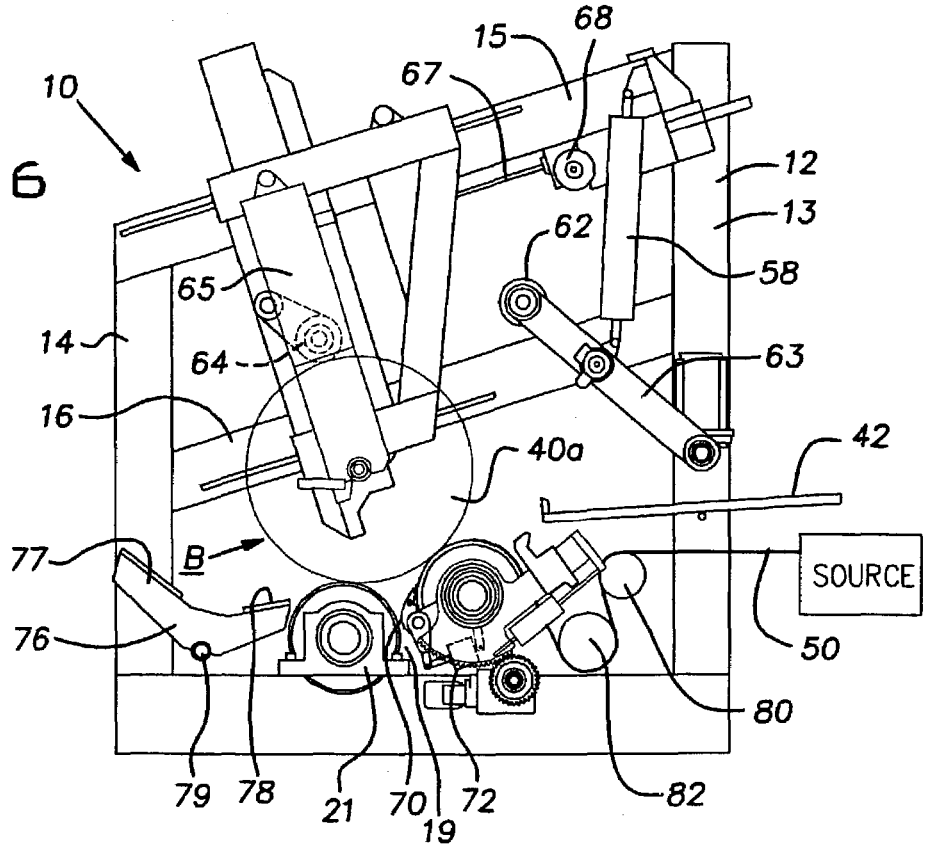
FIG. 6 is a side view as in FIG. 5, at a still further stage of the winding operation with the central core and wound material having advanced to a primary winding position.
Figure 7:
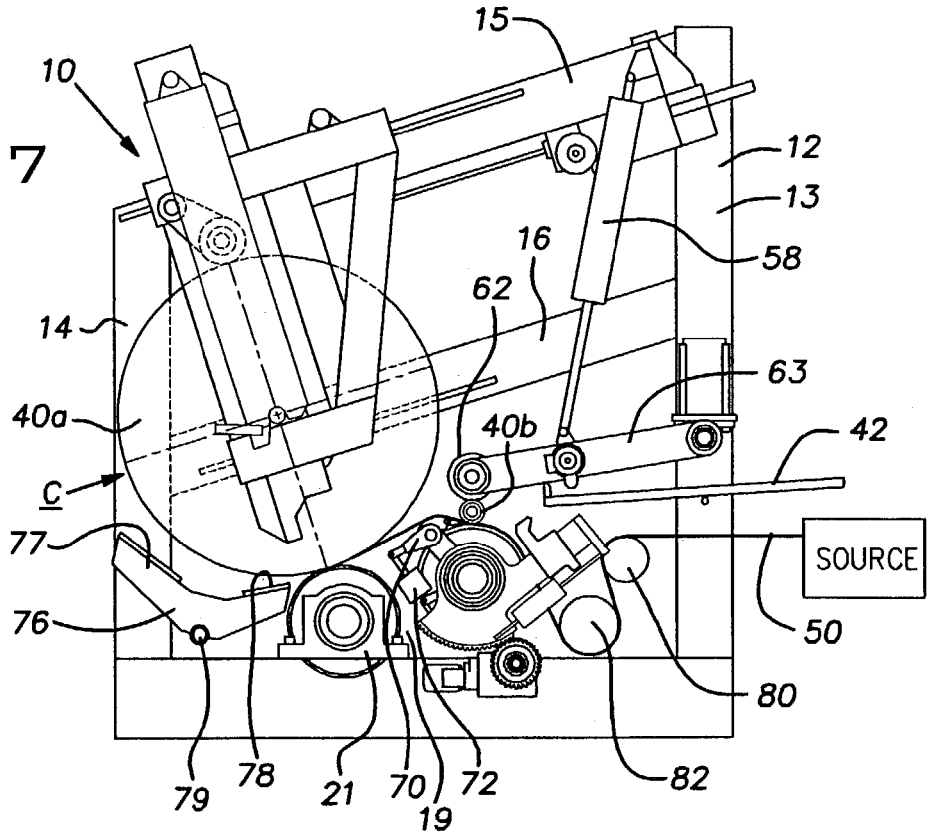
FIG. 7 is a side view as in FIG. 6, at a final stage of the winding operation with the central core and wound material forming a finished roll about to exit the machine at a finishing winding position, where the machine has a subsequent central core at the initial winding position.

Referring still to FIG. 5, the overhead carriage 65 is initially positioned such that the second friction roller 64 is properly aligned with the forming roll 40*a* in the initial position A (i.e. the substantially vertical path of the friction roller 64 is aligned with the roll 40*a* and leading winding drum 20). The roller 64 engages the roll 40*a* against the leading winding drum 20 once the first friction roller 62 has been retracted. Next, the overhead carriage 65 is translated, with downward force being applied against the roll 40*a* via the friction roller 64, such that the forming roll 40*a* is moved from the initial winding position A into the primary winding position B (shown in phantom in FIG. 5 and in solid in FIG. 6). In the primary winding position, the friction roller 64 supplies downward force to the forming roll 40*a* such that the roll 40*a* is supported by and pressed against both the leading winding drum 20 and the succeeding winding drum 22 as shown in FIG. 6, generally suspended between the drums 20, 22 over gap 19. As will be apparent from FIG. 6, in the primary winding position B, the relative positions of the leading and succeeding winding drums 20 and 22 (respective upper surfaces being vertically displaced by the distance D), results in the majority of the weight of the forming roll 40*a* being supported against the succeeding winding drum 22, with a smaller amount of its weight being supported against the leading winding drum 20. The result is that there is greater force exerted against the succeeding winding drum 22 by the forming roll 40*a* than against the leading winding drum 20. This is an important feature of the present invention as will be explained below. It is important that the substantially vertical pathway of the second friction roller 64 is properly aligned such that the downward force supplied from the second friction roller 64 is equally or substantially equally distributed against both the leading and succeeding winding drums 20 and 22. Otherwise, if the friction roller 64 supplies a larger force component to the leading roller than the succeeding roller, the larger force component may counteract the offset vertical alignment of the drums 20, 22 and result in equal force being applied to each winding drum by the forming roll 40*a*.

As web material is wound onto the roll 40*a* in the primary winding position B, its diameter continues to expand until a final diameter is reached. Once this final diameter is reached, the overhead carriage 65 is again translated (with the second friction roller 64 still engaged against the roll 40*a*) such that the roll 40*a* is now provided in a finishing winding position C, substantially adjacent the topmost portion of the surface of the succeeding winding drum 22. See FIG. 7. With the roll 40*a* in this position, a fresh central core 40*b* is supplied to the initial winding position A via the core carriage 44, and the web cutting device 70 is actuated as described above to sever the web 50 adjacent the fresh central core 40*b*, also described above. Once the web 50 has been severed, the second friction roller 64 is withdrawn from engagement from the finished roll 40*a*, which then is caused to roll out of the winding machine 10 due to the revolution of the succeeding winding drum 22. In a preferred embodiment, a roll delivery skid 76 is provided adjacent the succeeding winding drum 22 to receive a finished roll 40*a* therefrom. The skid 76 is generally L-shaped having a first support portion 77 and a second support portion 78 generally meeting or intersecting at a pivot or fulcrum 79. The skid 76 is adapted and positioned to receive the finished roll 40*a* from the winding drum 22 and deliver it gently, by operation of the fulcrum 79, to be rolled onto a surface adjacent the machine 10.

Referring generally to FIGS. 3–7, the web material is supplied from a web source outside of the machine from the side adjacent the leading winding drum 20. The web 50 is supplied to the machine 10 via first and second tension rollers 80 and 82 which are offset generally to provide an "S" configuration to the web 50 pathway through the tension rollers 80 and 82. Preferably, the diameter of the second tension roller 82 (the one closer to leading winding drum 20 relative to the web pathway) is larger than that of the first tension roller 80, resulting in greater surface area of contact with web 50 for the second tension roller 82 than for the first tension roller 80. The result is that there is greater tendency for slippage between the web 50 and the first tension roller 80 than between the web 50 and the second tension roller 82. Preferably, second tension roller 82 is rotated such that the linear speed at its circumference (i.e. effective linear speed of the web 50 at the surface of the roller) is slightly faster than that of first tension roller 80. The combination of higher speed and larger diameter of the second tension roller 82 relative to the first tension roller 80 results in a web 50 that is well tensioned in a very controllable manner. It is also important to note that this embodiment results in primary tensioning of the web being supplied ahead of the leading winding drum 20, which provides very effective web tensioning for winding web material around a core 40 in the initial winding position A atop the leading winding drum 20. Furthermore, it will be evident that in this arrangement, web tension between the leading winding drum 20 and the tension rollers 80, 82 is not diminished or affected by severance of the web between the leading and succeeding winding drums 20 and 22 when it is time to switch to a fresh core 40 in the initial winding position A (so long as the first friction roller 62 is engaged against the fresh core 40 and leading winding drum 20 when the web is severed, as will be the case during continuous operation of the winding machine 10). Preferably, the leading winding drum 20 has a faster circumferential linear speed than the second tension roller 82 to further tension the web 50 therebetween. In a preferred embodiment, the first and second tension rollers 80 and 82 and the leading winding drum 20 are operated by the same drive motor, and are respectively geared to achieve the above-described circumferential linear speed relationship among the two tension rollers and the leading winding drum.

When the roll 40 is in the primary winding position B, this is where the majority of winding of web material onto the core is performed; where the majority of diameter increase occurs. A principal problem with conventional winding machines is that it has been difficult to achieve uniform, tightly tensioned web winding across the entire radius of a finished web roll. The machine 10 of the present invention solves this problem as follows. As already explained, by providing the succeeding winding drum 22 in a lower, offset vertical alignment relative to the leading winding drum 20, in the primary winding position the majority of the weight of the forming roll 40 is supported against the succeeding winding drum 22. Therefore, there is a diminished tendency for slippage between the roll 40 and the succeeding winding drum 22 compared to between the roll 40 and the leading winding drum 20, because the roll is pressed against the leading winding drum 20 with less force than it is against the succeeding winding drum 22. Preferably, at least 60, preferably at least 65, preferably at least 70, preferably at least 75, preferably at least 80, preferably at least 85, percent of the weight of the roll 40 is supported against the succeeding winding drum 22 in the primary winding position B.

With a roll 40 in the primary winding position, the succeeding winding drum 22 is operated at a higher linear circumferential speed (effective linear speed of the web 50 at the surface of the roller) than the leading winding, drum 20. The result is that the roll 40 is caused to rotate at a speed determined by the linear circumferential speed of the succeeding winding drum 22, with the roll 40 slipping at its point (line) of contact against the slower-rotating leading winding drum 20. This, in turn, further tensions the web material 50 being wound to the roll 40 between the points (lines) of contact of the roll 40 with the succeeding and leading winding drums 22 and 20 respectively. The overall result is that once freshly wound web material 50 passes the point (line) of contact with the succeeding winding drum 22 as the roll 40 rotates, the web material has been very tightly re-tensioned against the roll 40, which provides very uniformly and highly tensioned finished web rolls in a highly reproducible manner upon exiting the machine. This tensioning of the web 50 in the primary winding position B is in addition to, and performed independently from any prior tensioning of the web 50 ahead of the primary winding position B relative to the web pathway through the machine 10; e.g. by tension rollers 80, 82. For a given web material, the layer density of a finished roll can be controlled, to some extent, by regulating the relative linear circumferential speeds of the leading and succeeding winding drums 20 and 22. A result of this tensioning step at the primary winding position B is that the web tension on the finished rolls (and layer density) are adjustable largely independently of the web tension rollers 80 and 82.

Thus, a winding machine according to the invention provides dual stage tensioning; with a first tensioning stage being provided substantially prior to the web 50 entering the machine 10 (i.e. ahead of the leading winding drum 20 relative to the web pathway), and a second tensioning stage provided just prior to (as pair of) the primary rolling operation with the forming roll 40 in a primary winding position B. The first tensioning stage is responsible for providing initial web tension between the source of web material and the leading winding drum 20; it is not responsible for supplying tension to the web 50 in order to provide the finished rolls to ensure that they are tightly wound having uniform layer density. This has been a primary drawback to prior art machines; the tension rollers supplied to tension the web 50 from the source of web material to the winding machine 10 were also relied upon to supply primary tension to the web material as it was wound around a core to provide a finished web roll. This arrangement has resulted in largely non-uniform web rolls, with un-reproducible results in terms of layer density and tension of web material in the finished roll. The present invention solves this problem via the vertically offset succeeding and leading winding drums 22 and 20 respectively, together with their relative linear circumferential speed differential as previously described. Not only can web rolls be provided having uniform layer density by the present invention, but successive web rolls can be provided having substantially constant layer density among the successive rolls.

It will now be clear why it is important that each of the leading and succeeding winding drums 20 and 22 is coupled to its own respective drive motor 24 and 26 respectively. Alternatively, both drums 20 and 22 can be driven by the same drive motor so long as the drums are geared (e.g. via conventional transmission means, torque converter, etc.) such that the succeeding winding drum 22 rotates with a higher linear circumferential speed relative to the leading winding drum 20.

In a further alternative embodiment, the overhead carriage assembly 65 can be replaced with a pivot assembly (not shown) by which the second friction roller 64 is pivoted (rather than translated) from an overhead pivot point. In this embodiment, it is important that the substantially vertical translation path of the second friction roller 64 be properly aligned such that the downward force supplied from the second friction roller 64 is equally or substantially equally distributed against both the leading and succeeding winding drums 20 and 22 in the primary winding position B as described above. The location of the pivot point (including altitude) should be carefully selected to achieve this alignment with a roll 40 in the primary winding position B.

Figure 8:
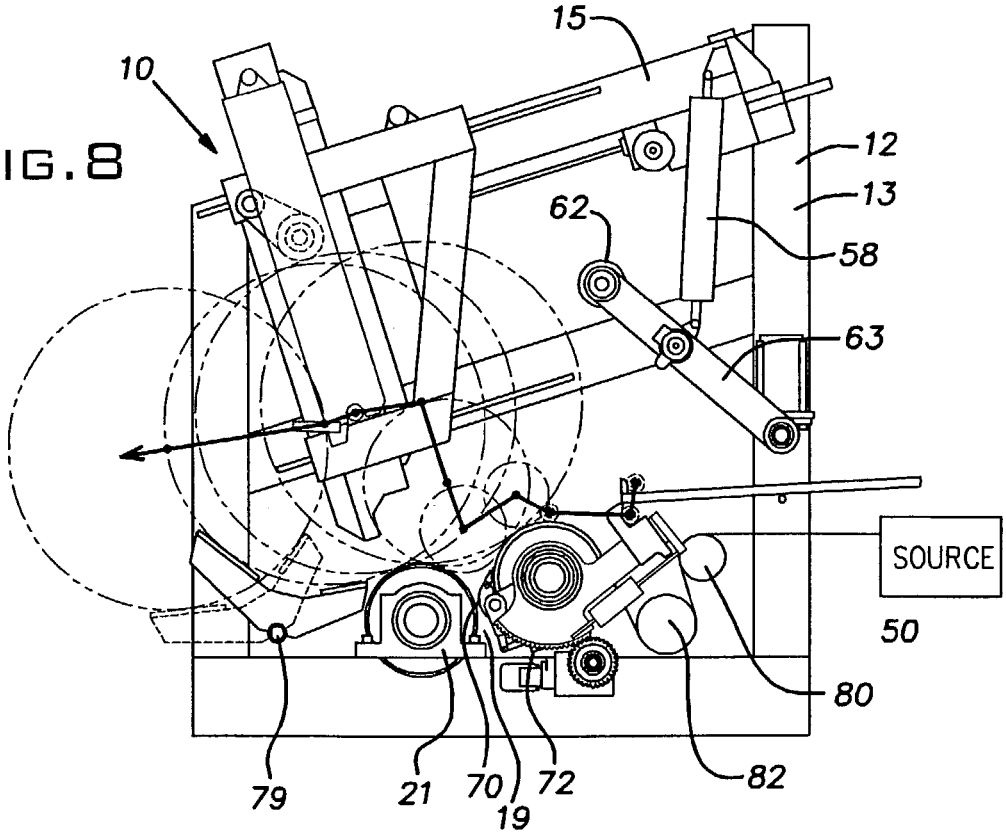
FIG. 8 is a side schematic view of a dual-drum winding machine according to the invention, depicting the progress of a central core and web material wound thereto through the machine according to a preferred embodiment of the invention.

FIG. 8 schematically depicts the progress of a particular roll 40 through the winding machine. In sum, a core 40 is supplied to the machine via the delivery ramp 42. The core carriage 44 conveys the core 40 circumferentially around the leading winding drum 20 into the initial winding position A adjacent the topmost position of the surface of the drum 20 where it is engaged from above by the first friction roller 62. The web 50 is initially wound to the core 40 in this position until, after some increase in diameter, the first friction roller 62 is withdrawn, and the forming roll 40 is engaged by a second friction roller 64. The forming roll 40 is then conveyed from the initial winding position into a primary winding position B between the leading and succeeding winding drums 20 and 22. In this position, the majority of web winding (diameter increase) occurs. From the primary winding position B, the roll 40 is conveyed to the finishing winding position C, at which point the web cutting device 70 severs the web and delivers it to a subsequent core in the initial winding position. The finished roll 40 is then delivered from the machine via the delivery skid 76 and the process begins again.

From the above description, it will be clear that the invented machine 10 operates or is operable on a continuous basis, to provide a continuous supply of uniformly tightly and reproducibly wound web rolls of a characteristic layer density so long as the supply of fresh cores and web material are not exhausted. This is a significant advance over the continuous winding machines of the prior art which do not produce such uniformly tightly wound web rolls, both because tight uniform tensioning is impossible on such machines, and also because a significant loose flap portion, having myriad imperfections such as rolls and creases, is inevitably applied to each successive core, resulting in a significant portion of each roll adjacent the core being unusable or of diminished value.

Although particular embodiments of the invention have been described in detail, it will be understood that the invention is not limited correspondingly in scope, but includes all changes and modifications coming within the spirit and scope of the appended claims.

What is claimed is:

1. A winding machine for winding a web of material around a central core to produce a web roll, said machine comprising a leading winding drum having a surface and a succeeding winding drum having a surface, said leading and succeeding winding drums being aligned and cooperating to support a web roll therebetween in a primary winding position such that in said primary winding position said web roll will contact said leading winding drum at a leading contact point and said succeeding winding drum at a succeeding contact point, said leading and succeeding winding drums being further arranged such that said leading contact point is located in a horizontal plane above said succeeding contact point, said machine further comprising pretensioning means for tensioning said web of material prior to reaching said primary winding position during operation of said machine, a first friction roller effective to retractably engage and press said core against said leading winding drum, and a second friction roller effective to retractably engage and press said web roll against both said leading and succeeding winding drums in said primary winding position.

2. A winding machine according to claim 1, said leading and succeeding winding drums being arranged such that a first horizontal plane tangent to a topmost position of the surface of said leading winding drum is located above a second horizontal plane tangent to a topmost position of the surface of said succeeding winding drum.

3. A winding machine according to claim 2, said first horizontal plane being located at least 1 inch above said second horizontal plane.

4. A winding machine according to claim 2, said first horizontal plane being located at least 2 inches above said second horizontal plane.

5. A winding machine according to claim 2, said first horizontal plane being located at least 6 inches above said second horizontal plane.

6. A winding machine according to claim 2, said first horizontal plane being located at least 12 inches above said second horizontal plane.

7. A winding machine according to claim 1, further comprising a web cutting device having a knife for severing said web, said cutting device being arranged such that said knife is translatable substantially circumferentially about said leading winding drum from a resting position thereof to a cutting position where said knife is positioned adjacent the topmost position of the surface of said leading winding drum.

8. A winding machine according to claim 7, said resting position of said cutting device being located between said leading winding drum and said succeeding winding drum.

9. A winding machine according to claim 7, said cutting device comprising a substantially arc shaped portion having a convex surface, said knife being provided to said arc shaped portion at an end thereof.

10. A winding machine according to claim 1, said second friction roller further being effective to retractably engage and press said core against said leading winding drum in an initial winding position of said web roll, and against said succeeding winding drum in a finishing winding position of said web roll.

11. A winding machine according to claim 10, further comprising means for translating said second friction roller along a substantially vertical path to engage said web roll in said initial, primary and finishing winding positions respectively.

12. A winding machine according to claim 11, wherein when said web roll is in said primary winding position, being pressed by said second friction roller against both said leading and succeeding winding drums, said substantially vertical pathway of said second friction roller is aligned such that a force supplied from said second friction roller to said web roll is substantially equally distributed against both said leading and succeeding winding drums.

13. A winding machine according to claim 11, said second friction roller and means for translating it along said substantially vertical path being carried on an overhead carriage that is translatable in a direction transverse to the central axes of the leading and succeeding winding drums to thereby align said substantially vertical path of said second friction roller with an appropriate one of said initial, primary and finishing winding positions of said web roll during operation of said winding machine.

14. A winding machine according to claim 1, said pretensioning, means comprising first and second tension rollers, said first and second tension rollers being arranged to provide an "S" configuration to a web pathway of said winding machine negotiating said first and second tension rollers, said first and second tension rollers being located ahead of said leading winding drum relative to said web pathway.

15. A winding machine according to claim 14, said second tension roller having a larger diameter than said first tension roller, said first tension roller being located ahead of said second tension roller relative to said web pathway.

16. A winding machine according to claim 1, said leading and succeeding winding drums being arranged such that a web roll located in said primary winding position has at least 60 percent of its weight being supported against said succeeding winding drum.

17. A winding machine according to claim 16, said leading and succeeding winding drums being rotatable such that a linear circumferential speed of said succeeding winding drum is greater than a linear circumferential speed of said leading winding drum, such that said web of material being wound to said roll in said primary winding position is tensioned on said roll as a result of the relative linear circumferential speeds of said leading and succeeding winding drums causing slippage between said roll and said leading winding drum.

18. A winding machine according to claim 1, said leading and succeeding winding drums being arranged such that a web roll located in said primary winding position has at least 60 percent of its weight being supported against said succeeding winding drum.

19. A method for winding web material around a central core to produce a web roll, comprising the steps of:

a) providing a winding machine comprising a leading winding drum having a surface and a succeeding winding drum having a surface, said leading and succeeding winding drums being aligned and cooperating to support a web roll therebetween in a primary winding position such that in said primary winding position said web roll will contact said leading winding drum at a leading contact point and said succeeding winding drum at a succeeding contact point, said leading and succeeding winding drums being further arranged such that said leading contact point is located in a horizontal plane above said succeeding contact point;

b) providing a substantially cylindrical central core for winding said web material therearound to form a web roll;

c) supporting said web roll in said primary winding position against both said leading winding drum and said succeeding winding drum;

d) pretensioning said web of material prior to said web reaching said primary winding position;

e) winding said web material onto said web roll in said winding position; and f) rotating said succeeding winding drum at a higher linear circumferential speed than said leading winding drum to thereby further tension said web of material as it is wound onto said web roll.

20. A method according to claim 19, said winding machine further comprising first and second tension rollers located ahead of said leading winding drum relative to a web pathway of said winding machine, said first and second tension rollers being arranged to provide an "S" configuration to said web pathway negotiating said first and second tension rollers and being effective to pretension said web.

21. A method according to claim 20, further comprising rotating said second tension roller at a higher linear circumferential speed than said first tension roller, thereby supplying tension to said web material between a source of said web material and said leading winding drum, said first tension roller being located ahead of said second tension roller relative to said web pathway.

22. A method according to claim 21, said second tension roller having a larger diameter than said first tension roller.

23. A method according to claim 19, further comprising:

a) conveying said central core to an initial winding position adjacent a topmost position of said leading winding drum surface;

b) winding said web material onto said central core in said initial winding position to begin forming a web roll;

c) conveying said web roll from said initial winding position to said primary winding position where said web roll is supported against both said leading and succeeding winding drums; and d) further winding web material onto said web roll in said primary winding position.

24. A method according to claim 23, further comprising supplying a fresh central core to said initial winding position, severing said web material from said web roll, and rolling said web material, following severance thereof, onto said fresh central core to form a second web roll.

25. A method according to claim 24, further comprising conveying said web roll from said primary winding position to a finishing winding position adjacent a topmost position on the surface of said succeeding winding drum.

26. A method according to claim 24, said web material being severed less than 11 inches from said fresh cylindrical core located in said initial winding position.

27. A method according to claim 24, further comprising supplying additional tension to said web adjacent a point where said web is severed, such that a severed flap of said web recoils against said fresh central core in said initial winding position due to a rebounding force resulting from severing said web while supplying said additional tension thereto.

28. A method according to claim 19, further comprising operating said winding machine on a continuous basis to provide successive web rolls.

29. A method according to claim 28, said successive web rolls having substantially constant layer density.

30. A method according to claim 19, said web roll having substantially uniform layer density across the radius thereof.

31. A method according to claim 19, said leading and succeeding winding drums being arranged such that a first horizontal plane tangent to a topmost position of the surface of said leading winding drum is located above a second horizontal plane tangent to a topmost position of the surface of said succeeding winding drum.

* * * * *

UNITED STATES PATENT AND TRADEMARK OFFICE

CERTIFICATE OF CORRECTION

PATENT NO. : 7,114,675 B1
APPLICATION NO. : 10/443244
DATED : October 3, 2006
INVENTOR(S) : Herbert B. Kohler It is certified that error appears in the above-identified patent and that said Letters Patent is hereby corrected as shown below:

Column 9, line 26, please delete “pair”, and insert therefor --part--.

In the Claims, column 12, line 17, please delete the wording of claim 18, and insert therefor -- A winding machine according to claim 1, said leading and succeeding winding drums being operable to further tension said web of material as it is being wound around a web roll in said primary winding position during operation of said machine. --

Signed and Sealed this

Second Day of October, 2007

JON W. DUDAS
*Director of the United States Patent and Trademark Office*